US007192328B2

(12) United States Patent
Zawitz

(10) Patent No.: US 7,192,328 B2
(45) Date of Patent: Mar. 20, 2007

(54) TOY FOR SIMULATING CHARACTER MOTION

(75) Inventor: Richard E. Zawitz, South San Francisco, CA (US)

(73) Assignee: Tangle Inc., So. San Francisco, CA (US)

( * ) Notice: Subject to any disclaimer, the term of this patent is extended or adjusted under 35 U.S.C. 154(b) by 0 days.

(21) Appl. No.: 10/744,962

(22) Filed: Dec. 23, 2003

(65) Prior Publication Data

US 2005/0136792 A1 Jun. 23, 2005

(51) Int. Cl.
*A63H 33/12* (2006.01)

(52) U.S. Cl. ..... 446/102; 446/487; 446/489

(58) Field of Classification Search ..... 446/92, 446/227, 236, 314, 315, 489, 487, 102, 131; 434/259, 258, 247; 482/44, 47, 48; 273/109, 273/110, 112, 159, 440; 63/4, 10, 15, 21, 63/23

See application file for complete search history.

(56) References Cited

U.S. PATENT DOCUMENTS

| | | | | | |
|---|---|---|---|---|---|
| 153,717 | A | * | 8/1874 | Magerhaus | 273/158 |
| 616,208 | A | * | 12/1898 | Stanek | 273/159 |
| 662,171 | A | * | 11/1900 | Lederer | 63/21 |
| 913,689 | A | * | 3/1909 | Bullard | 273/159 |
| 956,632 | A | * | 5/1910 | Finch | 446/119 |
| 1,069,746 | A | | 8/1913 | Watts | |
| 1,322,966 | A | | 11/1919 | Sinclair | |
| 1,519,702 | A | * | 12/1924 | Preuss | 273/158 |
| 1,611,488 | A | | 12/1926 | Rocquin et al. | |
| 1,852,071 | A | | 4/1932 | Becker | |
| 2,073,346 | A | | 3/1937 | Clow | |
| D150,566 | S | * | 8/1948 | Grefe | D11/8 |
| 2,596,688 | A | * | 5/1952 | Hinsen | 273/112 |
| 2,662,335 | A | | 12/1953 | Calvertey | |
| D174,278 | S | * | 3/1955 | Katz | D11/83 |
| 2,703,724 | A | | 3/1955 | Der Yuen et al. | |
| 2,771,768 | A | * | 11/1956 | Tudor | 70/457 |

(Continued)

FOREIGN PATENT DOCUMENTS

| | | |
|---|---|---|
| DE | 2503780 | 5/1976 |

(Continued)

OTHER PUBLICATIONS

Decoy Dancer, Accessed Dec. 23, 2003 <http://www.decoydancer.com/products.html> <http://www.decoydancer.com/instructions.html>.

(Continued)

*Primary Examiner*—Bena Miller
(74) *Attorney, Agent, or Firm*—Townsend and Townsend and Crew LLP

(57) ABSTRACT

A method of simulating real-life motion of a character includes providing a toy having a plurality of interconnected links. The links are rotatably attached to one another and the character is attached to one of the links. The method also includes grasping the toy by holding two different links that are separated by at least two other links, one of which is the link to which the character is attached. The method also includes moving the hands with respect to one another, thus causing the character to move in a manner that simulates the real-life motion of the character.

19 Claims, 5 Drawing Sheets

U.S. PATENT DOCUMENTS

| | | | | | |
|---|---|---|---|---|---|
| D186,854 | S | * | 12/1959 | Nelson | D11/82 |
| 2,959,888 | A | | 11/1960 | Noble | |
| 2,992,495 | A | * | 7/1961 | Alvarine | 434/246 |
| 3,222,072 | A | * | 12/1965 | Dreyer | 273/157 R |
| 3,238,586 | A | | 3/1966 | Stoffel | |
| 3,251,103 | A | | 5/1966 | Saut | |
| 3,389,493 | A | | 6/1968 | Zysset | |
| 3,469,339 | A | | 9/1969 | Thomas | |
| 3,514,893 | A | | 6/1970 | Paksy | |
| 3,581,408 | A | * | 6/1971 | Mohier | 434/258 |
| D221,472 | S | * | 8/1971 | Wolfe | D11/83 |
| 3,597,872 | A | | 8/1971 | Venaela et al. | |
| 3,900,984 | A | * | 8/1975 | Garelick | 446/486 |
| 3,948,455 | A | | 4/1976 | Schwatrz | |
| 3,977,683 | A | | 8/1976 | Tomura | |
| 4,012,155 | A | | 3/1977 | Morris | |
| 4,031,635 | A | | 6/1977 | Brandt et al. | |
| 4,062,543 | A | * | 12/1977 | Loeffler | 273/110 |
| 4,071,244 | A | | 1/1978 | Richards | |
| 4,106,657 | A | | 8/1978 | Dogliotti | |
| 4,180,940 | A | * | 1/1980 | McMasters | 446/444 |
| 4,184,271 | A | | 1/1980 | Barnett, Jr. | |
| 4,214,747 | A | | 7/1980 | Rebajes | |
| 4,232,473 | A | | 11/1980 | Jenkins | |
| 4,259,821 | A | | 4/1981 | Bush | |
| 4,305,582 | A | | 12/1981 | Barton | |
| 4,325,698 | A | | 4/1982 | Darling et al. | |
| 4,362,031 | A | * | 12/1982 | Obermuller | 63/15 |
| 4,377,916 | A | | 3/1983 | Komiya | |
| 4,509,929 | A | * | 4/1985 | Zawitz | 446/102 |
| 4,738,558 | A | | 4/1988 | Hiromori | |
| 4,778,184 | A | | 10/1988 | Fleischer | |
| 4,784,391 | A | * | 11/1988 | Herron | 273/109 |
| 4,867,456 | A | * | 9/1989 | Weber et al. | 273/158 |
| 4,891,956 | A | * | 1/1990 | MacDonald | 63/3 |
| 4,935,995 | A | | 6/1990 | Daus, Jr. | |
| D312,981 | S | * | 12/1990 | Palmer | D11/83 |
| 5,018,252 | A | | 5/1991 | Butler | |
| 5,110,315 | A | | 5/1992 | Zawitz | |
| 5,172,534 | A | | 12/1992 | Milner et al. | |
| 5,233,780 | A | * | 8/1993 | Overholt | 43/2 |
| 5,392,554 | A | * | 2/1995 | Farstad et al. | 43/3 |
| 5,459,958 | A | * | 10/1995 | Reinke | 43/2 |
| 5,897,417 | A | | 4/1999 | Grey | |
| 5,901,491 | A | * | 5/1999 | Caldwell | 43/1 |
| 5,930,936 | A | | 8/1999 | Parr et al. | 43/3 |
| 6,070,356 | A | | 6/2000 | Brint et al. | 43/2 |
| 6,086,445 | A | | 7/2000 | Zawitz | |
| 6,212,816 | B1 | * | 4/2001 | Babbitt et al. | 43/3 |
| 6,266,912 | B1 | * | 7/2001 | Jirele | 43/2 |
| 6,357,161 | B1 | | 3/2002 | Best | 43/3 |
| 6,442,884 | B1 | * | 9/2002 | Sceery | 43/2 |
| 6,481,147 | B2 | * | 11/2002 | Lindaman | 43/2 |
| 6,574,902 | B1 | | 6/2003 | Conger | 43/2 |
| 6,574,904 | B1 | | 6/2003 | Fencel et al. | 43/3 |
| 2002/0095952 | A1 | * | 7/2002 | Kelly | 63/3 |
| 2003/0177686 | A1 | * | 9/2003 | Igo | 43/3 |

FOREIGN PATENT DOCUMENTS

| | | |
|---|---|---|
| FR | 1195407 | 11/1959 |
| FR | 2820339 | 8/2002 |
| WO | WO 87/00070 | 1/1987 |

OTHER PUBLICATIONS

Cabela's Waterfowl 2003 (magazine), pp. 31-36 Cabela's, Inc.; 1-800-237-1444 Sidney, NE <http://www.cabelas.com>.

* cited by examiner

TOY FOR SIMULATING CHARACTER MOTION

BACKGROUND OF THE INVENTION

The invention relates generally to the field of toys, and in particular to toys having a character wherein manipulation of the toy causes the character to move in a way that simulates the real-life movement of the character.

The use of interlocking pieces to form various geometric configurations has been the basis for a variety of toys. For example, LEGO brand building blocks have long been a popular toy. Other interlocking toy sets are described in U.S. Pat. Nos. 4,509,929, 5,110,315, and 5,172,534, the disclosures of which are herein incorporated by reference.

Although such toys have been generally commercially successful, it would be desirable to provide various improvements and diversifying features. Thus, embodiments of the present invention provide various enhancements to a toy system having a set of interlocking pieces.

BRIEF SUMMARY OF THE INVENTION

Embodiments of the invention thus provide a method of simulating real-life motion of a character. The method includes providing a toy having a plurality of interconnected links. Each link has two ends and a twisting axis at each of the two ends. Each twisting axis defines an end interface between adjacent pairs of links. Adjacent pairs of the links are rotatably interlocked one another at the end interface, to thereby allow at least 360 degrees of rotation, such that centerline symmetry is maintained at the end interface between adjacent pairs of links, and the character is attached to one of the links. The method also includes grasping the toy by holding two different links that are separated by at least two other links, one of which is the link to which the character is attached. The method also includes moving the hands with respect to one another, thus causing the character to move in a manner that simulates the real-life motion of the character.

In some embodiments, the plurality of links comprise links of at least two different sizes. The links may be round and may be torus sections. The torus sections may be, for example, one-quarter torus sections or one-eighth torus sections. The links may be square, tubular-shaped objects. The links may be identical. The method may include attaching the toy to a support structure and positioning the character in a position representative of an action pose of the character. The character may be a skateboarder, rollerblader, snowboarder, surfer, skier, butterfly, or the like. The links may form a continuous center line around the toy, and the continuous center line may be a line of radial symmetry of the toy.

In other embodiments, the invention provides a toy that includes a plurality of interconnected links attached to one another. The toy also includes a character attached to one of the links. The character may be manipulated by holding two different links with hands on either side of the character and moving the hands with respect to one another. This causes the character to move in a manner that simulates the real-life motion of the character.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components.

DETAILED DESCRIPTION OF THE INVENTION

According to embodiments of the present invention, a toy having a character is used to simulate the real-life motion of the character. The toy consists of a plurality of rotatably-coupled links that are interchangeable with one another. The links are connected end-to-end and form a ring. The links may be constructed of woods, plastics, composites, metals, and the like. Similar, previously-know such toys are more fully described in previously-incorporated U.S. Pat. Nos. 4,509,929, 5,110,315, and 5,172,534.

Figure 1:
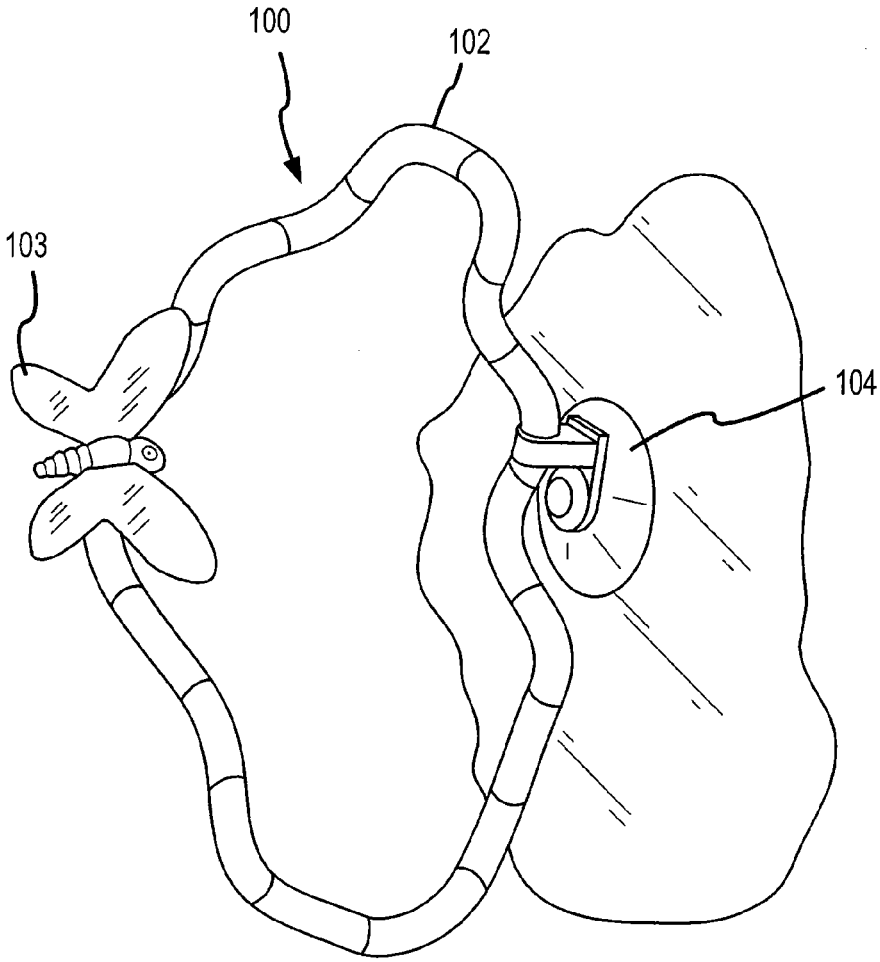
FIG. 1 illustrates a first embodiment of a toy according to the present invention.
Figure 2:
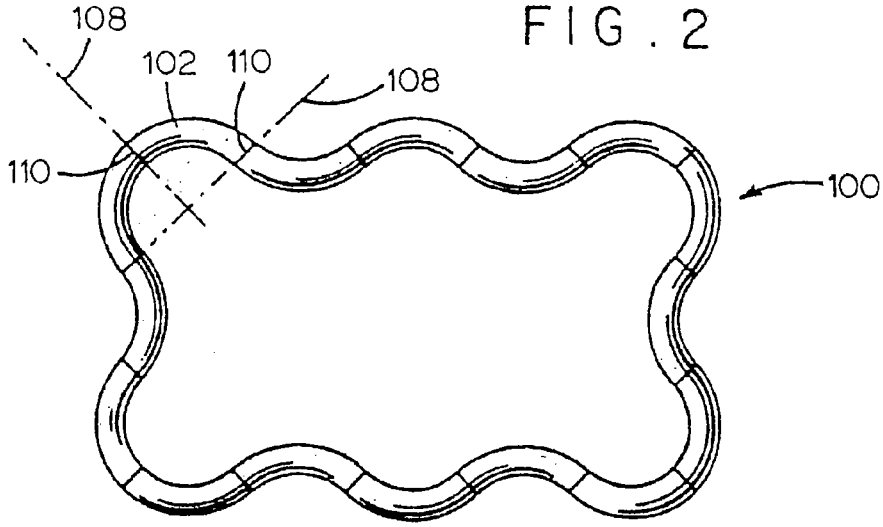
FIG. 2 PRIOR ART
FIG. 2 illustrates a second embodiment of a toy according to the present invention.

Attention is directed to FIGS. 1 and 2, which illustrate embodiments of the invention in greater detail. A toy 100 is formed by a plurality of pivotally connected segments 102, which may be twisted into an infinite variety of configurations such as the unique and decorative sculpture shown in FIG. 1. The toy has a character 103 attached thereto. A support base 104, in this case, a suction cup, is attached to a display surface and supports the smoothly curving toy 100 in a configuration that simulates an action pose of the character 103. The sculpture in the FIG. 1 embodiment has eighteen segments, while the embodiment of FIG. 2 (shown in a flat configuration and without a character attached thereto) has sixteen segments.

With reference to FIG. 2, it is shown that every segment 102 has a twisting axis 108 at each end thereof which pass through an end interface 110 between each pair of adjacent segments. Each segment may be twisted relative to either adjacent segment through 360 degrees by displacing or flipping the remainder of the toy 100.

The toy has an amazing retention property, which causes the segments thereof to remain in the last configuration set by the user. The toy is readily twistable into new configurations, but tends to retain the prior configuration until retwisted. Preferably, each extension fits snugly into the cooperating channel of the adjacent segment, which aids the retention property.

The torus curve along each segment body portion causes the two twisting axes of each segment to be nonaligned (at ninety degrees in the FIG. 2 embodiment). A single segment cannot be twisted relative to both adjacent segments at the same time, without displacing other segments within the toy. The segments cannot be displaced independently.

Even in the unusual case of axis alignment, the segments between the aligned interfaces can pivot or be displaced only as part of the group of adjacent segments bounded by the pair of aligned axes. These locked groups may be large (the entire toy) or small (four minimum) depending on the configuration. In some embodiments, each locked group must have at least four torus quadrant segments in order to present an accumulated axis shift of 360 degrees required for axis alignment.

Typically when the user initially twists the toy, the twisting axes are random and non-aligned. The initial locked group includes the entire chain of segments. The force required to displacement a single segment must be sufficient to disturb the entire toy, simultaneously moving every segment and reorienting every twisting axis. The chain-wide disturbance proceeds until two axes come into alignment. The initial resistance to change in the toy is the origin of the configuration retention characteristic. This initial resistance is at least in part responsible for the self-supporting feature of the sculpture 100 shown in FIG. 1. Minor displacement forces (such as gravity and occasional bumps) acting on the toy are insufficient to overcome the non-alignment resistance.

Hand action coupled with a low attention requirement is well known to have a tranquilizing effect. Crocheting and whittling are traditional examples of diversion-relaxation therapy. The present toy provides a similar tension relief function. Twisting the device is a simple, thoughtless procedure, which instantly produces unlimited fascinating and unpredictable configurations. With each twist of the segments, the device undergoes a chain-wide transformation in silhouette and axis orientation without repetition. The device functions as a mechanical or sculptural kaleidoscope, with a corresponding relaxing, mesmeric characteristic.

The continuous center line of symmetry around the toy insures that each of the infinite random configurations will have a smooth and graceful silhouette, which contributes to the relaxation of the user. The torus section embodiments produces only continuous configurations free from geometric or mathematical discontinuities (no infinite derivatives).

The toy may be displayed as a stationary artistic sculpture without change, and still have a desirable therapeutic effect. The flowing appearance of the toy contributes to a relaxing atmosphere.

Any number of segments may be included in the toy to provide a wide range of configurations. Straight segments and shorter curved segments may also be employed in a toy to modify the scope of possible configurations. Further, rather than being limited to round tubes, the segments may be square tubes or may be other shapes.

Figure 3A:
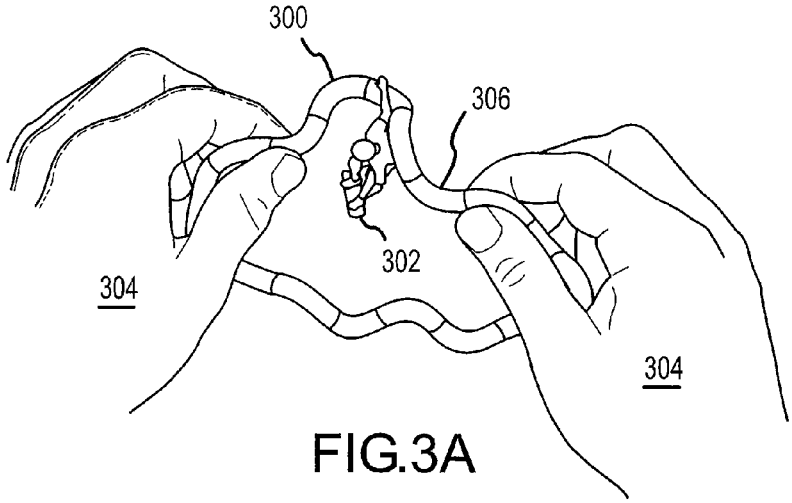
FIGS. 3A–3C illustrate how a toy according to an embodiment of the invention may be manipulated so as to simulate the real-life motion of a character.
Figure 3B:
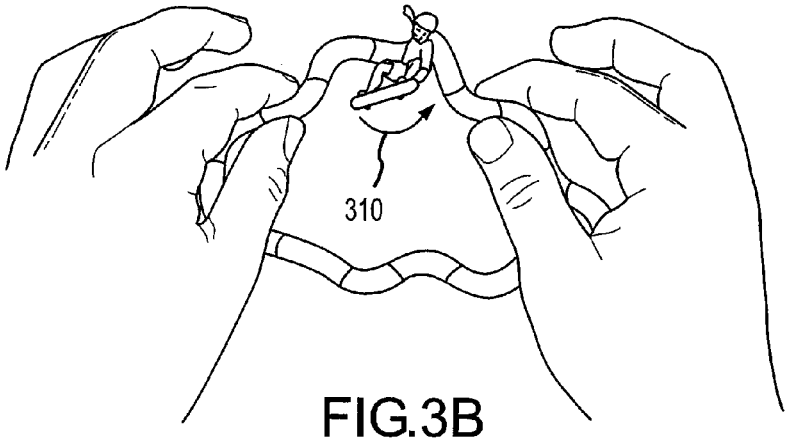
Figure 3C:
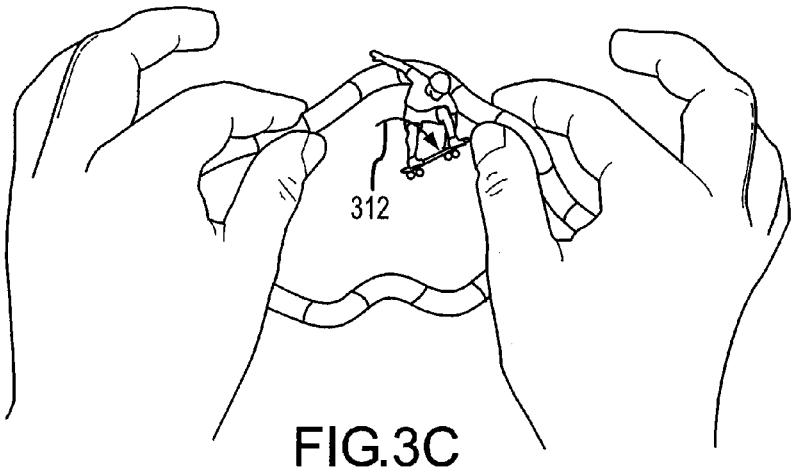

Attention is directed to FIGS. 3A–3C, which illustrate a toy 300 having a character 302, in this case a skateboarder, being manipulated so as to simulate real-life motion of the character. The movement of the toy causes the skateboarder to appear to skateboard over infinitely varying hills. As shown in FIG. 3A, a person grasps the toy 300 with his hands 304 in two places so that at least two (but preferably more) links 306 are between the user's hands, and the character 302 is attached to one of those two links. Then the user manipulates the toy by moving his hands so as to cause the links to move with respect to one another. As a result, the character moves along with the link to which the character is attached. This activity may be particularly enjoyable for children who may develop skill in manipulating the character in a desired fashion.

Because of the way the character moves with the link, the motion of the character follows a generally circular path as shown by the movement arrows 310, 312 of FIGS. 3B and 3C, respectively. This movement generally approximates the real-life movement of an analogous character. For example, skateboarders, rollerbladers, surfers, snowboarders, and the like, often move in circular paths as they climb half-pipes, carve turns, rip waves, and such. Further, the randomizing nature of the toy's movement makes the character appear to move almost independently of the actions of the user. This feature adds to the enjoyment experienced by many users and introduces a challenge as users attempt to control the character's movement.

Figure 4:
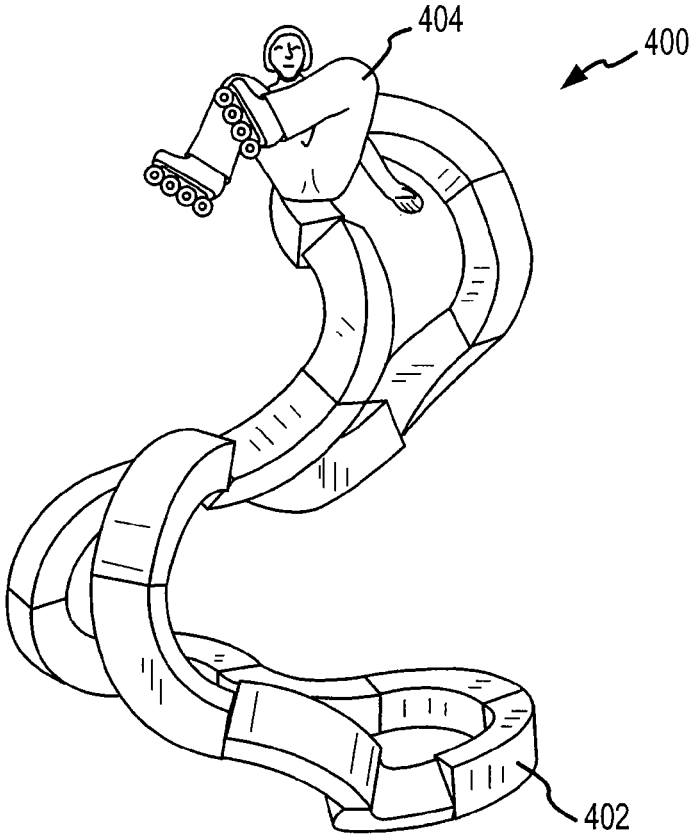
FIG. 4 illustrates a third embodiment of a toy according to the present invention.
Figure 5:
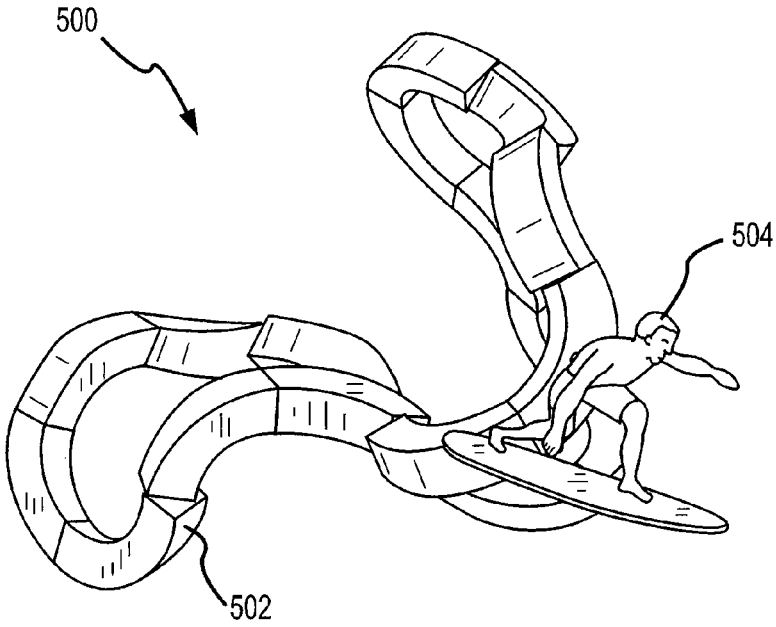
FIG. 5 illustrates a fourth embodiment of a toy according to the present invention.

Attention is directed to FIG. 4, which illustrates another embodiment of a toy 400, in this case one having square links 402 and a rollerblader character 404. FIG. 5 illustrates a toy 500 having square links 502 and a surfer character 504.

Having described several embodiments, it will be recognized by those of skill in the art that various modifications, alternative constructions, and equivalents may be used without departing from the spirit of the invention. Additionally, a number of well known processes and elements have not been described in order to avoid unnecessarily obscuring the present invention. For example, those skilled in the art know how to manufacture modeled plastic parts for toys such as those described herein. Accordingly, the above description should not be taken as limiting the scope of the invention, which is defined in the following claims.

What is claimed is:

1. A method of simulating real-life motion of a character, comprising:

providing a toy having a plurality of interlocking links, wherein each link has two ends and a twisting axis at each of the two ends, wherein each twisting axis defines an end interface between adjacent pairs of links, wherein adjacent pairs of the links are rotatably interlocked to one another at the end interface, to thereby allow at least 360 degrees of rotation, such that centerline symmetry is maintained at the end interface between adjacent pairs of links, wherein the character comprises a selection from the group consisting of skateboarder, rollerblader, snowboarder, surfer, skier, and butterfly, and wherein the character is attached to one of the plurality of links;

with hands, grasping the toy by holding two different of the plurality of links, wherein the two different links are separated by at least two other of the plurality of links, one of the two other of the plurality of links being the link to which the character is attached;

moving the hands with respect to one another, thereby causing the character to move in a manner that simulates the real-life motion of the character.

2. The method of claim 1, wherein the plurality of links comprise links of at least two different sizes.

3. The method of claim 1, wherein the links are round and comprise torus sections.

4. The method of claim 3, wherein the torus sections comprise one-quaffer torus sections.

5. The method of claim 3, wherein the torus sections comprise one-eighth torus sections.

6. The method of claim 1, wherein the links comprise square, tubular-shaped objects.

7. The method of claim 1, wherein the links are identical.

8. The method of claim 1, further comprising attaching the toy to a support structure and positioning the character in a position representative of an action pose of the character.

9. The method of claim 1, wherein the links form a continuous center line around the toy, and wherein the continuous center line comprises a line of radial symmetry of the toy.

10. A toy, comprising:

a plurality of interlocking links, wherein each link has two ends and a twisting axis at each of the two ends, wherein each twisting axis defines an end interface between adjacent pairs of links, wherein adjacent pairs of the links are rotatably interlocked to one another at the end interface, to thereby allow at least 360 degrees of rotation with respect to one another, such that centerline symmetry is maintained at the end interface between adjacent pairs of links;

a character attached to one of the plurality of links, wherein the character comprises a torso, arms, and legs, and whereby the character may be manipulated by holding two different of the plurality of links with hands on either side of the character and moving the hands with respect to one another, thereby causing the character to move in a manner that simulates the real-life motion of the character.

11. The toy of claim 10, wherein the plurality of links comprise links of at least two different sizes.

12. The toy of claim 10, wherein the links are round and comprise torus sections.

13. The toy of claim 12, wherein the torus sections comprise one-quarter torus sections.

14. The toy of claim 12, wherein the torus sections comprise one-eighth torus sections.

15. The toy of claim 10, wherein the links are identical.

16. The toy of claim 10, wherein the links comprise square, tubular-shaped objects.

17. The toy of claim 10, further comprising a support structure to which the plurality of link are attached, the support structure configured to support the character in a position representative of an action pose of the character.

18. The toy of claim 10, wherein the character comprises a selection from the group consisting of skateboarder, rollerblader, snowboarder, surfer, and skier.

19. The toy of claim 10, wherein the links form a continuous center line around the toy, and wherein the continuous center line comprises a line of radial symmetry of the toy.

* * * * *

UNITED STATES PATENT AND TRADEMARK OFFICE

CERTIFICATE OF CORRECTION

PATENT NO. : 7,192,328 B2
APPLICATION NO. : 10/744962
DATED : March 20, 2007
INVENTOR(S) : Richard E. Zawitz It is certified that error appears in the above-identified patent and that said Letters Patent is hereby corrected as shown below:

Column 4, claim 4, line 48, delete "one-quaffer" and insert --one-quarter--

Signed and Sealed this

Twenty-eighth Day of August, 2007

JON W. DUDAS
*Director of the United States Patent and Trademark Office*